US008820314B1

(12) United States Patent
Johnson et al.

(10) Patent No.: US 8,820,314 B1
(45) Date of Patent: Sep. 2, 2014

(54) EXTENDIBLE OVEN RACK APPARATUS

(75) Inventors: William Jacob Johnson, Nashville, TN (US); David Dwain Davies, Nashville, TN (US); Phillip Kent Rollins, Nashville, TN (US)

(73) Assignee: Nashville Wire Products Mfg. Co., Nashville, TN (US)

( * ) Notice: Subject to any disclaimer, the term of this patent is extended or adjusted under 35 U.S.C. 154(b) by 991 days.

(21) Appl. No.: 12/888,997

(22) Filed: Sep. 23, 2010

(51) Int. Cl.
*F24C 15/16* (2006.01)

(52) U.S. Cl.
USPC ..... 126/339; 126/337 R; 126/332; 312/350

(58) Field of Classification Search
CPC ..... F24C 15/16; F24C 15/168; F24C 15/18; F25D 25/02; F25D 25/025
USPC ..... 126/339, 337 R, 332, 333; 312/350, 280
See application file for complete search history.

(56) References Cited

U.S. PATENT DOCUMENTS

| | | | | |
|---|---|---|---|---|
| 1,341,829 | A | | 6/1920 | Whittinghill |
| 1,918,457 | A | | 7/1933 | Dowell |
| 1,934,125 | A | | 11/1933 | Hurt |
| 1,989,275 | A | | 1/1935 | Hatch |
| 2,011,189 | A | | 8/1935 | Anderson |
| 2,080,907 | A | | 5/1937 | Buchanan |
| 2,089,359 | A | | 8/1937 | Goulooze |
| 2,157,608 | A | | 5/1939 | Hoffstetter et al. |
| 2,188,044 | A | | 1/1940 | Hickman |
| 2,207,115 | A | | 7/1940 | Carr |
| 2,466,360 | A | | 4/1949 | Bitney |
| 2,564,473 | A | | 8/1951 | Ferguson |
| 2,633,400 | A | | 3/1953 | Ring |
| 2,671,004 | A | | 3/1954 | Chadwick et al. |
| 2,758,455 | A | | 8/1956 | Anderson |
| 2,841,132 | A | | 7/1958 | Philipp |
| 2,875,016 | A | | 2/1959 | Fry |
| 2,912,554 | A | | 11/1959 | Snyder |
| 3,278,250 | A | * | 10/1966 | Vogt ..... 312/334.12 |
| 3,344,779 | A | | 10/1967 | Johnson |
| 3,716,284 | A | | 2/1973 | Vogt |
| 3,936,627 | A | | 2/1976 | Fitzmayer |

(Continued)

FOREIGN PATENT DOCUMENTS

| | | | |
|---|---|---|---|
| GB | 2196527 | A | 5/1988 |
| JP | 4354903 | A | 12/1992 |

OTHER PUBLICATIONS

Exhibit A: 3 sheets, including 1 drawing and 2 photographs of a prior art sliding oven rack with latch (undated but admitted to be prior art).

(Continued)

*Primary Examiner* — Avinash Savani
(74) *Attorney, Agent, or Firm* — Waddey & Patterson, P.C.; Lucian Wayne Beavers; J. Crockett Hailey, III

(57) ABSTRACT

An extendible oven rack apparatus includes an oven rack, a lower frame and first and second slide assemblies connected between the oven rack and lower frame. A locking assembly is connected to the lower frame for selectively locking the lower frame into the oven. The locking assembly includes a locking pin laterally movable relative to the lower frame and a locking bar longitudinally slidable relative to the lower frame for selectively locking the locking pin its laterally outward position.

25 Claims, 11 Drawing Sheets

(56) References Cited

U.S. PATENT DOCUMENTS

| | | | | |
|---|---|---|---|---|
| 3,977,389 | A | | 8/1976 | Ondrasik, II |
| 3,984,163 | A | | 10/1976 | Boorman, Jr. et al. |
| 4,241,668 | A | | 12/1980 | Carroll |
| 5,303,997 | A | | 4/1994 | Kropf |
| 5,450,971 | A | | 9/1995 | Boron et al. |
| 5,462,347 | A | * | 10/1995 | Vogelgesang et al. ..... 312/247 |
| 5,601,038 | A | | 2/1997 | Welch et al. |
| 5,699,744 | A | | 12/1997 | Lechman |
| 6,148,813 | A | | 11/2000 | Barnes et al. |
| 6,422,399 | B1 | | 7/2002 | Castillo et al. |
| 6,578,720 | B1 | | 6/2003 | Wang |
| 6,578,939 | B1 | | 6/2003 | Mayer |
| 6,789,861 | B1 | | 9/2004 | Dobberstein |
| 6,854,379 | B2 | | 2/2005 | Pattle et al. |
| 6,938,617 | B2 | | 9/2005 | Le et al. |
| 7,087,862 | B1 | | 8/2006 | Shaffer et al. |
| 7,216,646 | B2 | | 5/2007 | Le et al. |
| 7,316,179 | B2 | | 1/2008 | Geberzahn et al. |
| 2006/0065265 | A1 | | 3/2006 | Erdmann et al. |
| 2009/0095279 | A1 | | 4/2009 | Ambrose et al. |
| 2010/0018517 | A1 | * | 1/2010 | Chen ..... 126/337 R |

OTHER PUBLICATIONS

Exhibit B: 6 sheets of drawings of General Electric sliding oven rack with latch (undated but admitted to be prior art).

* cited by examiner

EXTENDIBLE OVEN RACK APPARATUS

BACKGROUND OF THE INVENTION

1. Field of the Invention

The present disclosure relates to oven hardware and more particularly to an extendible oven rack apparatus.

2. Description of the Prior Art

Historically, most home ovens utilized sliding wire racks which were supported directly from grooves defined in the side walls of the oven liner. The wire racks would extend only partially out of the front opening of the oven because it was necessary for the rear portion of the wire racks to remain sufficiently engaged with the side walls of the oven in order to support the partially extended wire rack in a suitable manner to accommodate the loads of pots and pans thereon.

More recently, a large number of designs have been proposed for fully extendible oven rack assemblies wherein the oven rack is attached at each side to a telescoping slide assembly, including an outer member, which can remain securely attached to the oven wall, and an inner slide member, which allows the working portion of the oven rack to extend fully out of the front opening of the oven.

SUMMARY OF THE INVENTION

An extendible oven rack apparatus is provided for use in n oven having an oven wall. The apparatus includes an oven rack, a lower frame, and first and second slide assemblies connected between the oven rack and the lower frame so that the oven rack is longitudinally slidable relative to the lower frame out of and into the oven. A locking assembly is connected to the lower frame for selectively locking the lower frame into the oven. The locking assembly includes a locking pin and a locking bar. The locking pin is laterally movable relative to the lower frame between a laterally outward position and a laterally inward position. The locking bar is slidably connected to the lower frame and slidable relative to the lower frame in a straight generally longitudinal direction between a longitudinally inward locked position wherein the locking bar prevents the locking pin from moving from its laterally outward position to its laterally inward position, and a longitudinally outward unlocked position wherein the locking pin is free to move from its laterally outward position to its laterally inward position.

In another aspect of the invention an extendible oven rack apparatus includes an oven rack, a lower frame, and first and second slide assemblies supporting the oven rack from the lower frame so that the oven rack can slide in a longitudinal direction into and out of the oven. First and second locking assemblies are connected to the lower frame for selectively locking the lower frame to opposite side walls of the oven. Each locking assembly includes a flat plate spring, a locking protrusion, and a locking bar. The flat plate spring extends generally longitudinally and has a first end laterally fixed to the lower frame and has a free second end. The locking protrusion is attached to the free second end of the flat plate spring and extends laterally outward from the flat plate spring. The locking bar is slidably connected to the lower frame and longitudinally slidable between a locked position wherein an abutment surface of the locking bar is located laterally inward of and adjacent to the locking protrusion, so that the locking protrusion cannot be deflected laterally inward, and an unlocked position wherein the abutment surface is longitudinally offset from the locking protrusion so that the locking protrusion can be deflected laterally inward.

In another aspect of the invention an extendible oven rack apparatus is provided for use in an oven. The oven has left and right longitudinally extending oven walls. The oven rack apparatus includes a lower frame operative to engage the left and right oven walls to support the oven rack apparatus within the oven, an oven rack, and left and right slide assemblies connected between the lower frame and the oven rack. Left and right locking assemblies are connected to the lower frame. The left and right locking assemblies are operable independent of each other to lock the lower frame in place relative to the left and right oven walls, respectively. Each of the locking assemblies includes a human engageable operating member movable between a locked position and an unlocked position. The operating members are stable in their unlocked positions so that the apparatus can be removed from the oven without maintaining human operator engagement with the operating members.

In another aspect of the invention a method is provided for removing a longitudinally extendible oven rack assembly from an oven. The oven rack assembly includes an oven rack, a lower frame, two telescoping slide assemblies supporting the oven rack from the lower frame, and left and right locking assemblies selectively locking the lower frame to left and right oven walls, respectively. The method includes the steps of:

(a) independently moving each of the left and right locking assemblies to unlocked positions by human operator engagement with the locking assemblies;

(b) maintaining each of the locking assemblies in its unlocked position without maintaining human operator engagement with the locking assemblies; and (c) removing the oven rack assembly from the oven.

Numerous objects features and advantages of the present invention will be readily apparent to those skilled in the art upon a reading of the following disclosure when taken in conjunction with the accompanying drawings.

DETAILED DESCRIPTION

Figure 1:
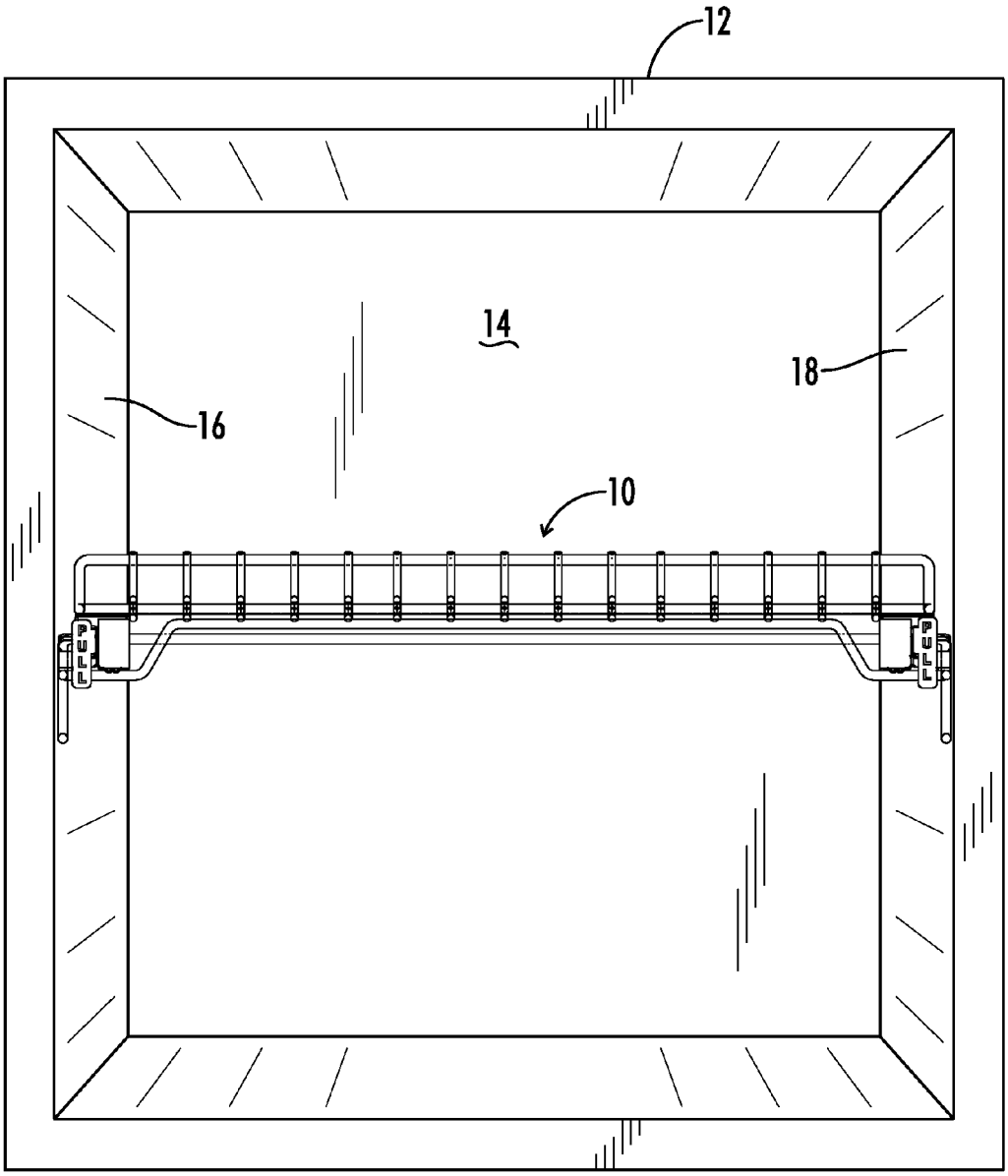
FIG. 1 is a front schematic perspective view of an extendible oven rack apparatus in place within an oven.

Referring now to FIG. 1, an extendible oven rack apparatus 10 is provided for use within an oven 12. The oven 12 has a cavity 14 defined in part by left and right oven walls 16 and 18.

Figure 2:
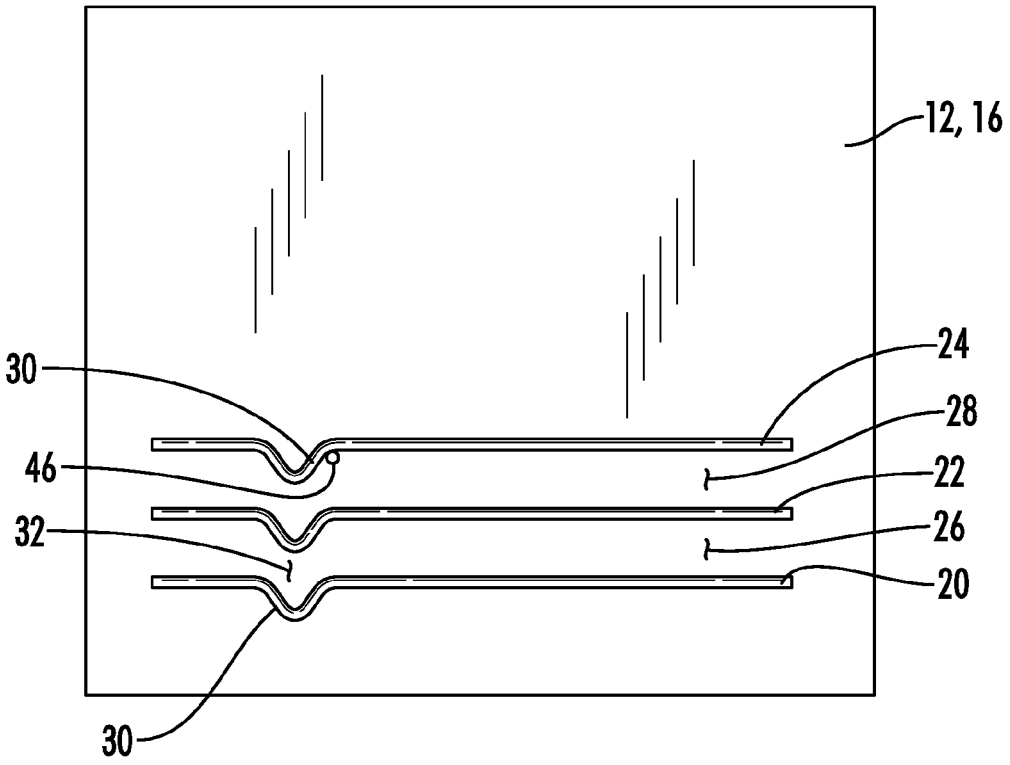
FIG. 2 is a schematic elevation view of the inside surface of the left wall of the oven of FIG. 1.

As is schematically illustrated in FIG. 2, each of the oven walls such as left oven wall 16 has a plurality of protruding ridges such as 20, 22 and 24 defined thereon which correspondingly define recesses such as 26 and 28 therebetween.

Each of the protruding ridges typically includes a downwardly dipped portion such as 30, which results in dips such as 32 within the recesses such as 26 between adjacent ridges.

An oven wall construction like that shown in FIG. 2 is well known in the art and allows oven racks of various types to be placed within the oven by inserting the rear end of the oven rack between two adjacent ridges with the rack tilted downwardly so as to fit within one of the dipped recesses such as 32 to get past the adjacent dips such as 30, and then the oven rack is pivoted to a horizontal orientation and can slide rearwardly into place within the oven. The present invention makes use of an oven wall structure like that of FIG. 2 in providing its ability to lock an extendible oven rack apparatus in place within the oven.

Figure 3:
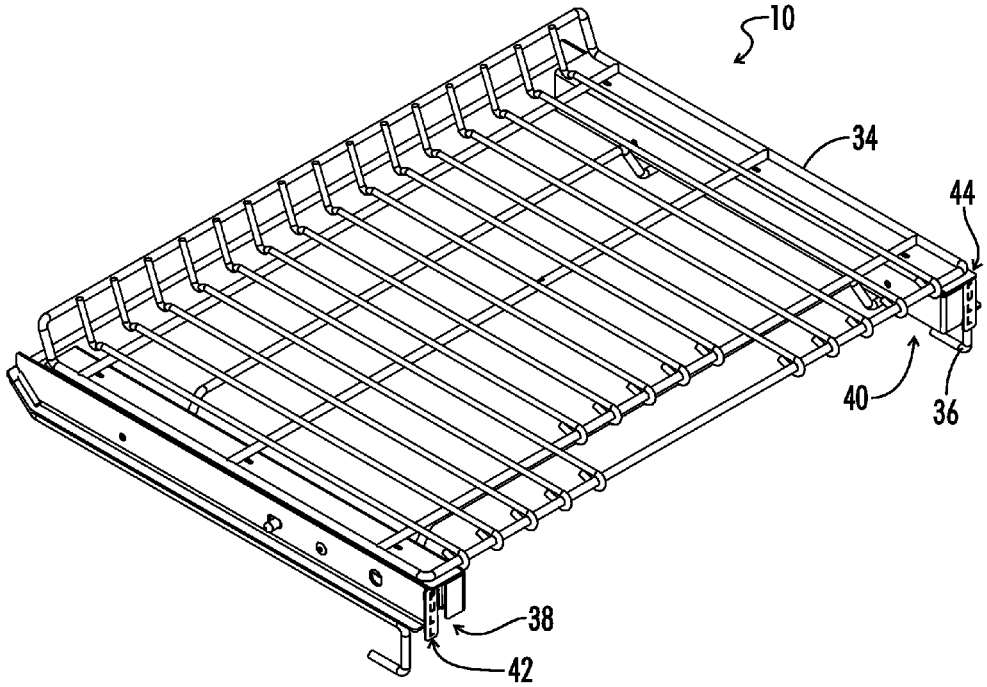
FIG. 3 is a perspective view of an extendible oven rack apparatus.

Referring now to FIG. 3, the extendible oven rack apparatus 10 includes an oven rack 34 and a lower frame 36. First and second or left and right slide assemblies 38 and 40 are connected between the oven rack 34 and the lower frame 36, and permit the oven rack 34 to slide out of and into the cavity 14 of oven 12. As is known in the art the slide assemblies may be constructed of two, three or more telescoping pieces providing relatively telescoping members which allow an appropriate extension of the oven rack 34 longitudinally relative to the lower frame 36. As is further explained below, the lower frame 36 will remain fixed in place relative to the oven 12 during typical usage of the oven rack 34, but when it is desired to completely remove the extendible oven rack assembly 10 from the oven 34 the lower frame 36 will be unlocked and the entire extendible oven rack assembly 10 will be removed from the oven 12.

Figure 4:
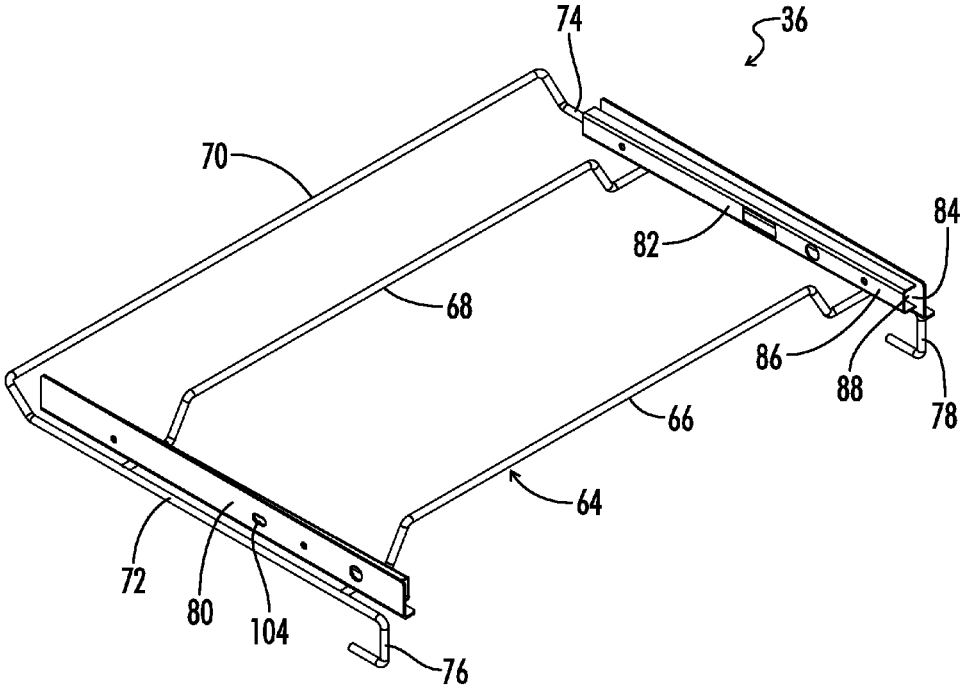
FIG. 4 is a perspective view of a lower frame of the oven rack apparatus of FIG. 3.

FIG. 4 shows an upper left perspective view of the lower frame 36 without the other components of the oven rack apparatus 10.

The extendible oven rack apparatus 10 is further provided with first and second or left and right locking assemblies 42 and 44 for selectively locking the lower frame 36 in place within the oven 10. The two locking assemblies are generally mirror images of each other.

Figure 5:
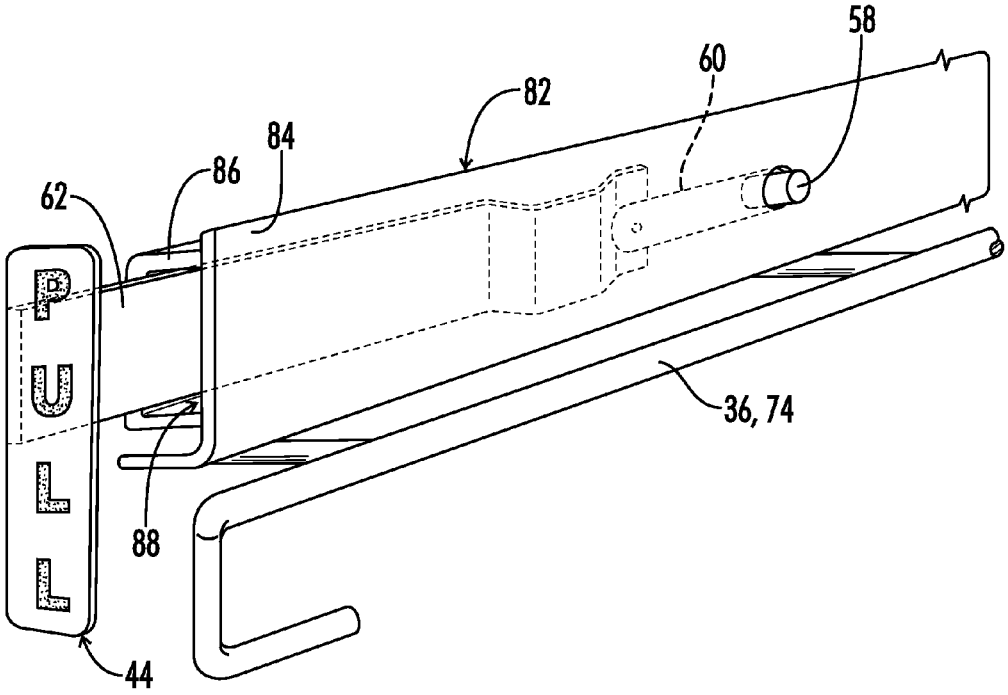
FIG. 5 is a right front perspective view of the right hand side of the extendible oven rack apparatus of FIG. 3 showing a locking bar in its longitudinally outward unlocked position.
Figure 6:
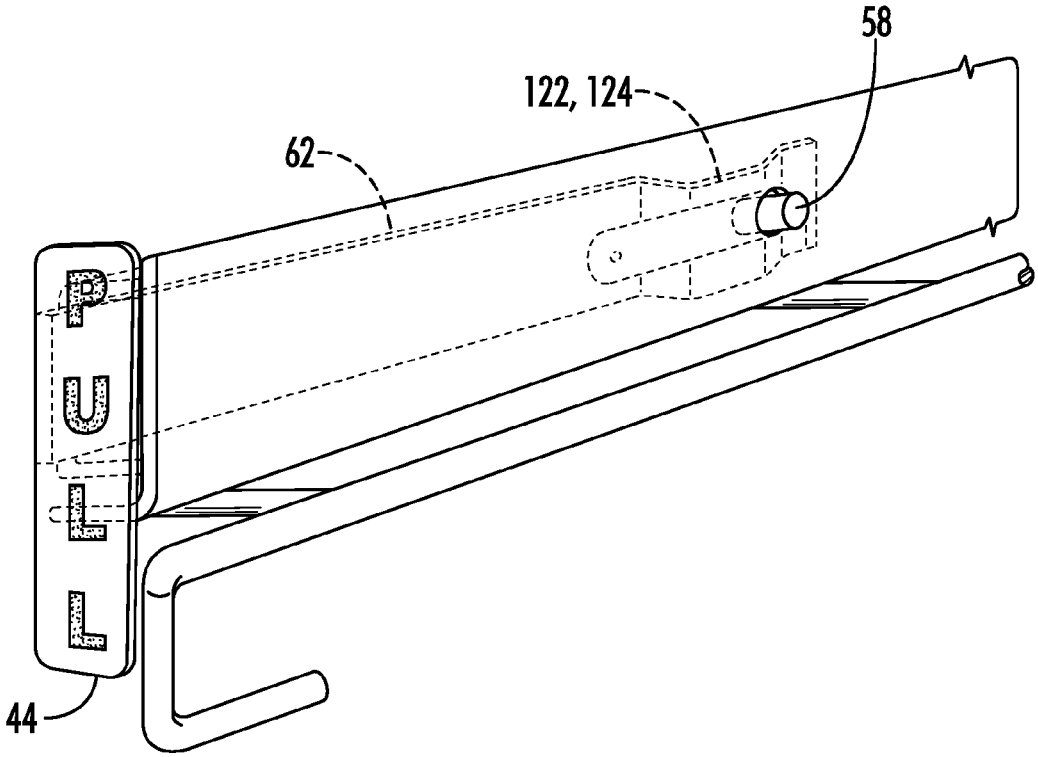
FIG. 6 is a view similar to FIG. 5 showing the locking bar in its longitudinally inward locked position.
Figure 14A:
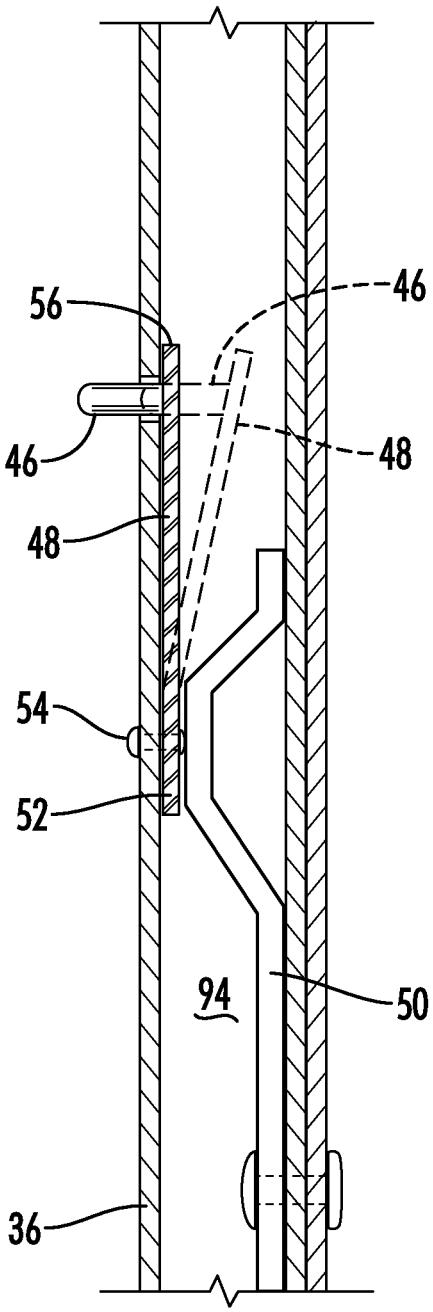
FIG. 14A is a schematic plan sectioned view taken along line 14-14 of FIG. 15 showing the relative positions of the left locking assembly within the lower frame. The locking assembly is shown in its unlocked position.
Figure 14B:
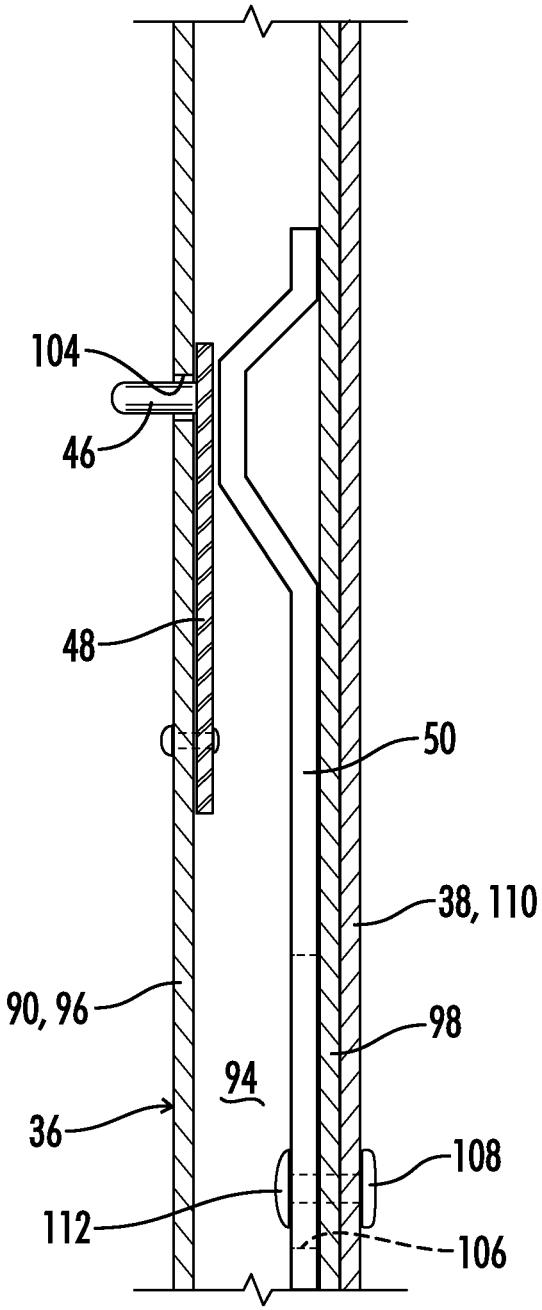
FIG. 14B is a view similar to FIG. 14A showing the locking assembly in its locked position.
Figure 15:
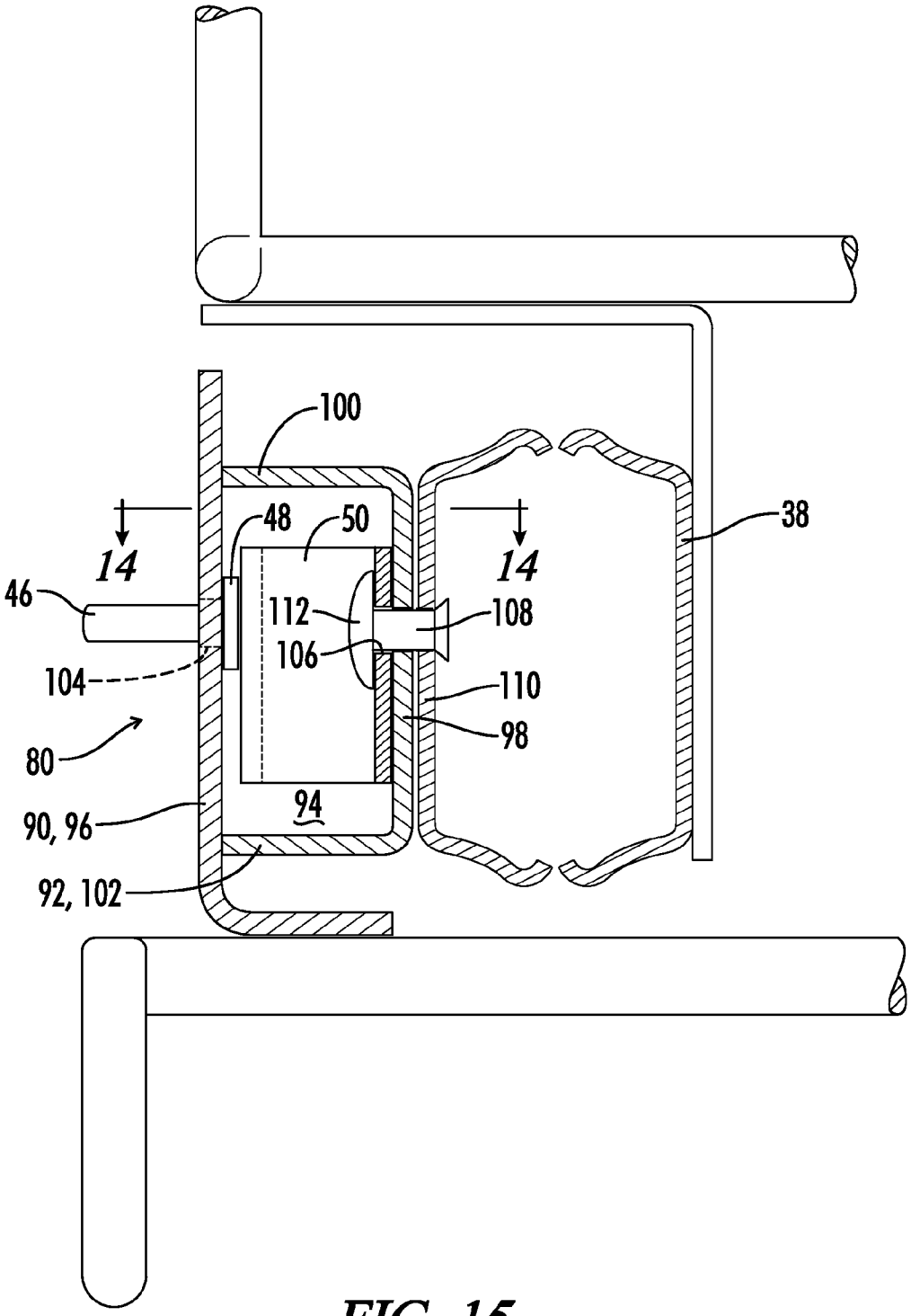
FIG. 15 is a front elevation schematic view showing an enlarged view of the left side of the apparatus of FIG. 3 and particularly illustrating the relationship between the oven rack, the lower frame, and the left slide assembly.

Details of the left hand locking assembly 42 are visible in FIGS. 14A, 14B and 15. The right hand locking assembly 44 is shown in FIGS. 5 and 6 from a different perspective.

Referring to FIGS. 14A, 14B and 15, the left hand locking assembly 42 includes a locking pin or locking protrusion 46 which is mounted on a flexible flat plate spring 48 and is laterally movable relative to the lower frame 36 between a laterally outward position shown in solid lines in FIG. 14A and a laterally inward position shown in dash lines in FIG. 14A.

The left locking assembly 42 further includes a locking bar 50 slidably connected to the lower frame 36 and slidable relative to the lower frame 36 in a straight generally longitudinal direction between a longitudinally inward locked position as shown in FIG. 14B wherein the locking bar 50 prevents the locking pin 46 from moving from its laterally outward position to its laterally inward position, and a longitudinally outward unlocked position shown in FIG. 14A wherein the locking pin 46 is free to move from its laterally outward position shown in solid lines in FIG. 14A to its laterally inward position shown in dash lines in FIG. 14A.

The spring 48 biases the locking pin 46 from its laterally inward position shown in dash lines in FIG. 14A toward and to its laterally outward position shown in solid lines in FIG. 14A. The flexible plate spring 48 has one end 52 attached to the lower frame 36 such as by rivet 54 and has another free end 56 to which the locking pin 46 is attached. The plate spring 48 extends generally longitudinally as seen in solid lines in FIG. 14A when the plate spring is in a relaxed state and the locking pin 46 is in its laterally outward position.

As seen in FIGS. 5 and 6, the right hand locking assembly 44 similarly includes a locking pin 58 attached to a plate spring 60, and a locking bar 62 which interacts with the plate spring 60 and the locking pin 58.

Referring again to FIG. 4, the details of the lower frame 36 are there best seen. The lower frame 36 includes a wire portion 64 having first, second and third laterally extending cross bars 66, 68 and 70 and left and right longitudinally extending bars 72 and 74, all of which are joined together such as by welding. The longitudinal bars 72 and 74 have downwardly extending hook portions 76 and 78, respectively, which will each fit over the forward end of one of the oven wall ridges such as 20-24.

Left and right enclosure portions 80 and 82 are attached to the wire portion 36. As best seen for example in FIG. 5, the right hand enclosure portion 82 includes an angle shaped sheet metal member 84 and a channel shaped sheet metal member 86 which are joined together to form a right hand longitudinally extending passage 88 within which the plate spring 60 and locking bar 62 are received. Thus, the enclosure formed by channel member 86 and angle member 84 defining the passage 88 protects the locking assembly 44 from food debris within the oven 12.

Similarly, as best seen in FIG. 15, the left side enclosure portion 80 is formed of an angle shaped member 90 and a channel shaped member 92 joined together to define a left hand longitudinal passage 94 within which the plate spring 48 and locking bar 50 of the first locking assembly 42 are received.

With reference to FIG. 15, the enclosure portion 80 can be described as an elongated enclosure extending generally longitudinally from the front of the apparatus 10 toward the rear of the apparatus 10, with the enclosure portion 80 including a laterally outer wall 96, a laterally inner wall 98, an upper wall 100, and a lower wall 102.

The laterally outer wall 96 has a pin hole 104 defined therethrough. The locking pin 46 extends laterally outward through the pin hole 104 when the locking pin 46 is in its laterally outward position as shown for example in FIG. 15.

Figure 7:
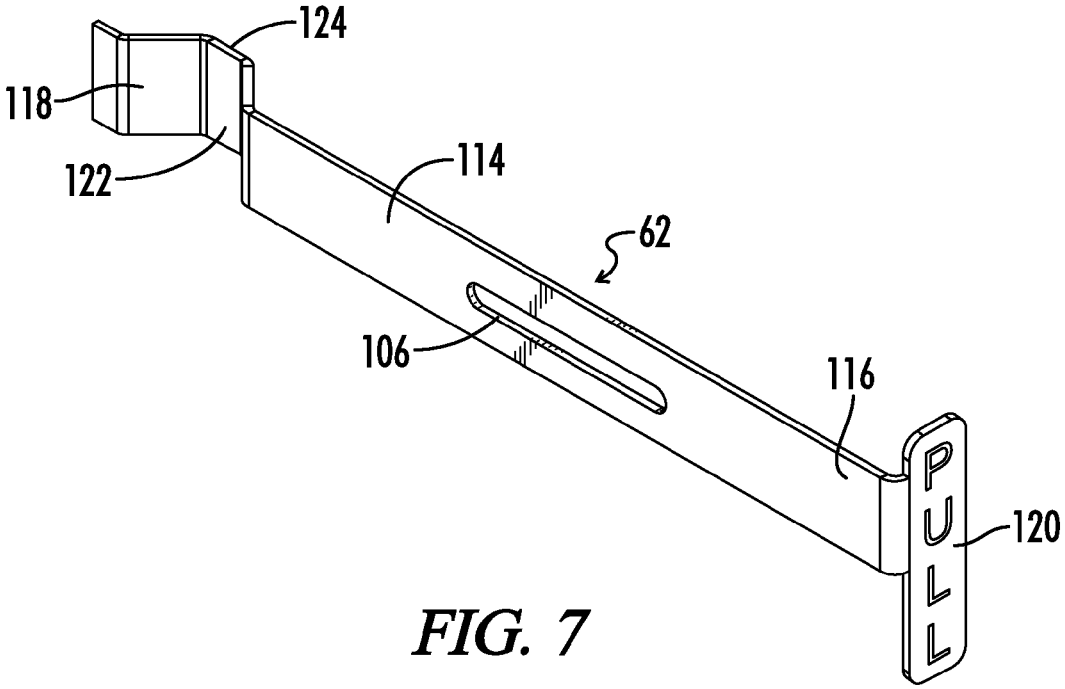
FIG. 7 is a left upper perspective view of the right hand locking bar of the apparatus of FIG. 3.
Figure 8:
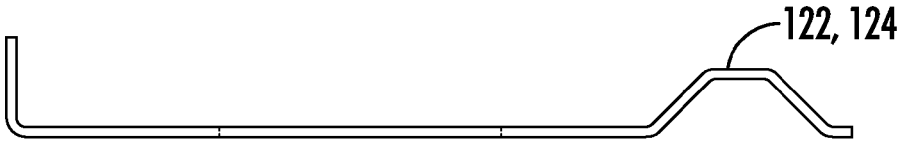
FIG. 8 is a bottom view of the locking bar of FIG. 7.
Figure 9:
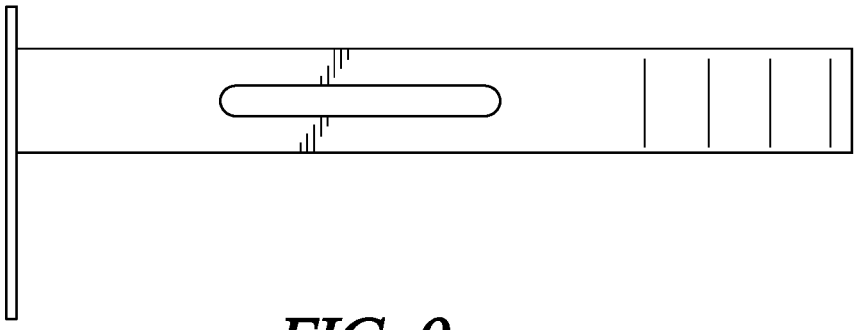
FIG. 9 is a right side elevation view of the locking bar of FIG. 7.
Figure 10:
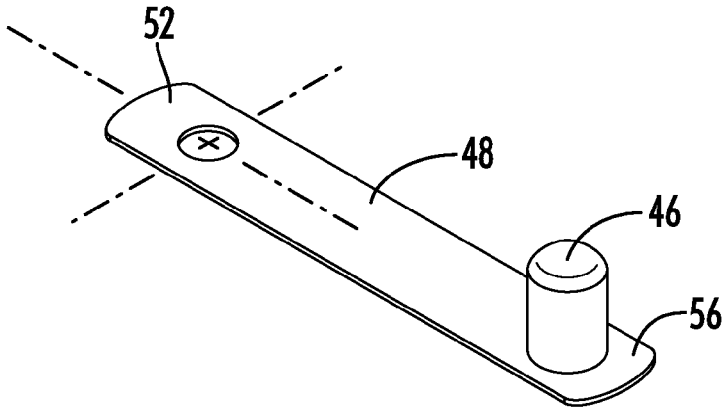
FIG. 10 is a perspective view of a flat plate spring and locking pin used with the apparatus of FIG. 3.
Figure 11:
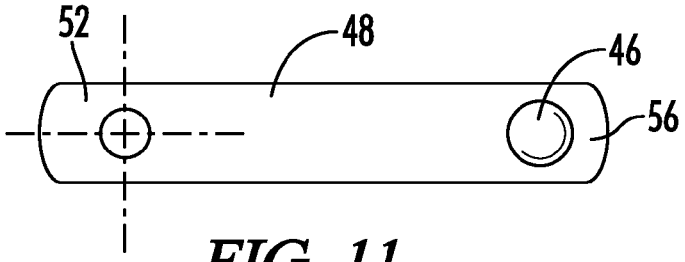
FIG. 11 is a side elevation view of the apparatus of FIG. 10.
Figure 12:
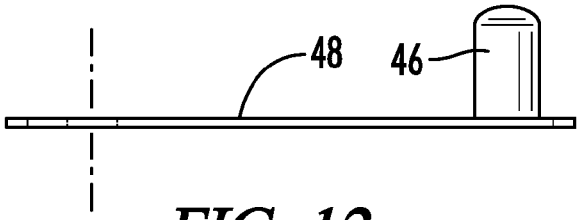
FIG. 12 is a top plan view of the apparatus of FIG. 10.
Figure 13:
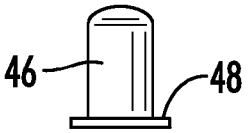
FIG. 13 is an end view of the apparatus of FIG. 10.

As best seen in FIGS. 7 and 9, each of the locking bars 62 and 72 has a guide slot such as 106 defined therein. The locking assembly further includes a guide pin, such as the guide pin 108 seen in FIG. 14B extending through its associated guide slot 106. The guide pin such as 108 extends into its associated longitudinal enclosure from the laterally inner wall 98. As is best seen in FIGS. 14B and 15, the guide pin 108 also extends through a laterally outer telescoping member 110 of the associated slide assembly 38. The guide pin 108 may be welded to the outer telescoping member 110 and the laterally inner wall 98, and it has an enlarged head 112 which laterally holds the sliding locking bar 50 on the guide pin 108.

As best seen in FIG. 7, the locking bar 62 can be generally described as having a longitudinally extending bar portion 114 having a forward end 116 and a rearward end 118. A handle 120 is attached to or defined on the forward end 116 for engagement by a human operator to move the locking bar between its locked and unlocked positions. The locking bar 62 further includes a lateral protrusion 122 on the bar portion near the rear end 118. The lateral protrusion 122 includes a laterally extending engagement surface or abutment surface 124 for holding the locking pin 58 in its laterally outward position as represented for example in FIG. 6. It is noted that when the lateral protrusion such as 124 is located laterally inward of and adjacent the locking pin 58 as shown in FIG. 6, the lateral protrusion 122 of the locking bar 62 prevents the locking pin 58 from being pushed inward to its laterally inward position. As is further described below this will lock the extendible oven rack apparatus 10 in place within the oven 12. It is also noted that when the locking bar 62 is in its locked position as shown in FIG. 6 with its lateral protrusion preventing the locking pin 58 from moving inward, the locking bar 64 itself is not longitudinally biased by any laterally inward force acting upon the locking pin 58. This absence of any longitudinal force on locking bar 62 is a result of the fact that the engagement surface 124 is a flat longitudinally extending surface and any force acting thereupon from the locking pin 58 will be only lateral and not longitudinal.

It is further noted that the two locking assemblies 42 and 44 are independently operable to lock the lower frame 36 in position relative to the opposite left and right sides 16 and 18 of the oven 12.

Additionally, each of the locking bars is positionally stable and longitudinally non-biased when in its unlocked position, so that the locking bars will remain in their unlocked positions without further human engagement with the locking bars.

Methods of Use

The methods of use of the extendible oven rack apparatus 10 and its installation and removal from the oven 12 will now be described.

The location and dimension of the locking pins 46 and 58 is such that if the oven rack apparatus 10 is in place within the oven 12 and if the locking assemblies have their locking bars 50 and 62 in their longitudinally inward locked positions, the locking pins will be prevented from deflecting inwardly and will prevent the lower frame 36 from being removed from the oven 12.

With reference to FIG. 2, when the lower frame 36 is locked in place within the oven, and assuming that the lower frame 36 is mounted on the second ridge 22, then the left side locking pin 46 will be located approximately at the location indicated in FIG. 2 wherein it will be prevented from sliding longitudinally forward due to its engagement with the downwardly dipping portion 30 of the third ridge 24. Thus, when the lower frame 36 is locked in place within the oven 12, the lower frame 36 securely holds the entire extendible oven rack apparatus 10 in place and supports it against the loads thereon from cooking dishes and the like located upon the oven rack, particularly when the oven rack is telescoped outward to allow items to be placed on or removed from the oven rack.

When it is desired to remove the oven rack apparatus 10 from the oven 12, each of the left and right locking assemblies 42 and 44 is independently moved to its unlocked position by a human operator engaging the handle such as 120 of each locking bar and independently sliding each locking bar to its longitudinally outward unlocked position. It is noted that when the locking bars are in their longitudinally outward unlocked position such as shown for example in FIG. 5 for the right side locking bar 62, the locking assemblies are maintained in their unlocked positions without maintaining human operator engagement with the locking assemblies.

Thus, the human operator could remove the oven rack apparatus 10 from the oven 12 with one hand. This could be accomplished by independently moving each of the locking bars to its unlocked position, then grasping the oven rack with one hand and pulling it forward and tilting it upward to remove it from the oven.

Although the oven rack can of course be removed with both hands, it is significant to note that it is not necessary for the human operator to maintain any engagement with the locking bars during the removal process after the locking bars have been moved to their unlocked positions.

It is additionally noted that to reinstall the extendible oven rack apparatus 10 into the oven 12, the locking bars must be in their unlocked position. With the locking bars in their unlocked position, when the locking pins 46 and 58 engage the ridges such as 20-24 of the oven, the pins can be deflected laterally inward so that they will move past the downwardly dipped portions 30 of the associated locking ridges.

Thus the locking assemblies of the apparatus 10 are simple in their construction, and simple and convenient in their use. They securely latch the oven rack assembly in place within the oven when in their locked positions, and when moved to their unlocked positions they will stay in their unlocked positions without further human engagement.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the appended claims.

What is claimed is:

1. An extendible oven rack apparatus for use in an oven, the oven having an oven wall, the apparatus comprising:

an oven rack;

a lower frame;

first and second slide assemblies connected between the oven rack and the lower frame so that the oven rack is longitudinally slidable relative to the lower frame out of and into the oven; and a locking assembly connected to the lower frame for selectively locking the lower frame into the oven, the locking assembly including:

a locking pin laterally movable relative to the lower frame between a laterally outward position and a laterally inward position; and a locking bar slidably connected to the lower frame and slidable relative to the lower frame in a straight generally longitudinal direction between a longitudinally inward locked position wherein the locking bar prevents the locking pin from moving from its laterally outward position to its laterally inward position, and a longitudinally outward unlocked position wherein the locking pin is free to move from its laterally outward position to its laterally inward position.

2. The apparatus of claim 1, wherein the locking assembly further comprises:

a spring operably associated with the locking pin to bias the locking pin from its laterally inward position toward its laterally outward position.

3. The apparatus of claim 2, wherein:

the spring comprises a spring plate having one end attached to the lower frame and having another end attached to the locking pin.

4. The apparatus of claim 3, wherein:

the spring plate extends generally longitudinally when the spring plate is in a relaxed state and the locking pin is in its laterally outward position.

5. The apparatus of claim 2, wherein:

the lower frame includes an enclosure having a passage defined therein, the spring and the locking bar being received in the passage so that the enclosure protects the locking assembly from food debris within the oven.

6. The apparatus of claim 5, wherein:

the enclosure is an elongated enclosure extending generally longitudinally from a front of the apparatus toward a rear of the apparatus, and the enclosure includes a laterally outer wall, a laterally inner wall, an upper wall and a lower wall; and the locking bar slides generally longitudinally within the enclosure.

7. The apparatus of claim 6, wherein:

the laterally outer wall of the enclosure has a pin hole defined therethrough; and the locking pin extends laterally outward through the pin hole when the locking pin is in its laterally outward position.

8. The apparatus of claim 7, wherein:

the spring comprises a spring plate attached to the laterally outer wall of the enclosure.

9. The apparatus of claim 6, wherein:

the locking bar has a guide slot defined therein; and the locking assembly further comprises a guide pin extending into the enclosure from the laterally inner wall, the guide pin being received through the guide slot of the locking bar.

10. The apparatus of claim 1, wherein the locking bar comprises:

a longitudinally extending bar portion having a forward end and a rearward end;

a handle attached to the forward end for engagement by a human operator to move the locking bar between its locked and unlocked positions; and a lateral protrusion on the bar portion, the lateral protrusion having an engagement surface for holding the locking pin in its laterally outward position without the locking bar being longitudinally biased by any laterally inward force acting upon the locking pin.

11. The apparatus of claim 10, wherein:

the engagement surface of the lateral protrusion comprises a generally longitudinally extending surface.

12. The apparatus of claim 1, further comprising:

a second locking assembly connected to the lower frame, the two locking assemblies being independently operable to lock the lower frame in position relative to opposite sides of the oven.

13. The apparatus of claim 12, wherein:

each of the locking assemblies is longitudinally non-biased when in its unlocked position, so that a human operator can place each locking assembly in its unlocked position and then remove the extendible oven rack assembly from the oven without maintaining human engagement with the locking assemblies.

14. An extendible oven rack apparatus, comprising:

an oven rack;

a lower frame;

first and second slide assemblies supporting the oven rack from the lower frame, so that the oven rack can slide in a longitudinal direction into and out of an oven; and first and second locking assemblies connected to the lower frame for selectively locking the lower frame to opposite side walls of the oven, each locking assembly including:

a flat plate spring extending generally longitudinally and having a first end laterally fixed to the lower frame and having a free second end;

a locking protrusion attached to the free second end of the flat plate spring and extending laterally outward from the flat plate spring; and a locking bar slidably connected to the lower frame and longitudinally slidable between a locked position wherein an abutment surface of the locking bar is located laterally inward of and adjacent to the locking protrusion so that the locking protrusion cannot be deflected laterally inward, and an unlocked position wherein the abutment surface is longitudinally offset from the locking protrusion so that the locking protrusion can be deflected laterally inward.

15. The apparatus of claim 14, wherein:

the flat plate spring biases the locking protrusion laterally outward.

16. The apparatus of claim 14, wherein:

the locking protrusion comprises a cylindrical pin.

17. The apparatus of claim 14, wherein:

the lower frame includes first and second longitudinally extending enclosures; and the first and second locking assemblies are received in the first and second longitudinally extending enclosures, so that the locking assemblies are protected from food debris.

18. The apparatus of claim 14, wherein:

each of the locking bars is positionally stable and longitudinally non-biased when in its unlocked position, so that the locking bars will remain in their unlocked positions without further human engagement with the locking bars.

19. An extendible oven rack apparatus for use in an oven, the oven having left and right longitudinally extending oven walls, the oven rack apparatus comprising:

a lower frame operative to engage the left and right oven walls to support the oven rack apparatus within the oven;

an oven rack;

left and right slide assemblies connected between the lower frame and the oven rack; and left and right locking assemblies connected to the lower frame, the left and right locking assemblies being operable independent of each other to lock the lower frame in place relative to the left and right oven walls, respectively, each of the locking assemblies including a human engageable operating member movable between a locked position and an unlocked position, the operating members being stable in their unlocked positions so that the apparatus can be removed from the oven without maintaining human operator engagement with the operating members.

20. The apparatus of claim 19, wherein:

each of the operating members is longitudinally slidable relative to the lower frame between the locked and unlocked positions of the operating member; and each operating member includes a forward end portion extending forward of the lower frame when the operating member is in the unlocked position.

21. The apparatus of claim 20, wherein the left locking assembly further comprises:

a spring biased latching pin movable laterally between a laterally inward position and a laterally outward position, the latching pin being biased toward its laterally outward position; and the operating member of the left locking assembly including a lateral protrusion for preventing the latching pin from moving from its laterally outward position to its laterally inward position.

22. The apparatus of claim 21, wherein:

the lateral protrusion includes a longitudinal portion for holding the latching pin in its laterally outward position.

23. The apparatus of claim 21, wherein:

the spring biased latching pin comprises a flat spring plate having one end attached to the lower frame and having another end engaged with the latching pin.

24. The apparatus of claim 19, wherein:

the lower frame includes left and right longitudinally extending enclosures having open forward ends; and the left and right locking assemblies are received within the left and right enclosures, respectively.

25. A method of removing a longitudinally extendible oven rack assembly from an oven including an oven cavity, the oven rack assembly including an oven rack, a lower frame, two telescoping slide assemblies supporting the oven rack from the lower frame, and left and right locking assemblies selectively locking the lower frame to left and right oven walls, respectively, each locking assembly including an operating member, the method comprising:

(a) independently moving each of the left and right locking assemblies to unlocked positions by human operator engagement with the locking assemblies by pulling the operating member of each of the locking assemblies longitudinally forward relative to the lower frame;

(b) maintaining each of the locking assemblies in its unlocked position without maintaining human operator engagement with the locking assemblies; and (c) removing the oven rack assembly from the oven.

* * * * *